US005566745A

United States Patent [19]

Hill et al.

[11] Patent Number: 5,566,745

[45] Date of Patent: Oct. 22, 1996

[54] SHUTTERED RADIATOR SYSTEM WITH CONTROL

[75] Inventors: James A. Hill, Pittsfield; Gregory A. Marsh, Erie; Myron L. Smith, Fairview, all of Pa.

[73] Assignee: General Electric Company, Erie, Pa.

[21] Appl. No.: 376,633

[22] Filed: Jan. 23, 1995

Related U.S. Application Data

[63] Continuation of Ser. No. 60,108, May 10, 1993, abandoned.

[51] Int. Cl.[6] ..... F01P 7/02; F01P 7/10

[52] U.S. Cl. ..... 165/299; 165/41; 165/51; 165/244; 123/41.04; 123/41.05; 123/41.12; 123/41.49; 417/423.8; 105/62.2

[58] Field of Search ..... 165/41, 99, 51, 165/39, 98; 105/62.2; 123/41.04, 41.05, 41.06, 41.12, 41.49; 417/423.8

[56] References Cited

U.S. PATENT DOCUMENTS

| | | | |
|---|---|---|---|
| 1,170,730 | 2/1916 | Benjamin et al. | 123/41.12 |
| 1,752,230 | 3/1930 | Burkhardt | 123/41.04 |
| 1,820,091 | 8/1931 | Reavis | 123/41.05 |
| 2,113,207 | 4/1938 | Yingling | 123/41.05 |
| 2,170,742 | 8/1939 | Yingling | 123/41.04 |
| 2,189,888 | 2/1940 | Endsley | 123/41.05 |
| 2,261,584 | 11/1941 | Knowlton et al. | 165/39 |
| 2,279,037 | 4/1942 | Endsley | 123/41.05 |
| 2,336,840 | 12/1943 | Brehob | 123/41.12 |
| 2,341,789 | 2/1944 | Justus | 123/41.05 |
| 2,423,929 | 7/1947 | Dilworth et al. | 123/41.04 |
| 2,474,394 | 6/1949 | Dilworth | 123/41.49 |
| 2,499,176 | 2/1950 | Barrell | 123/41.49 |
| 2,591,392 | 4/1951 | Weiser | 123/41.05 |
| 2,638,881 | 5/1953 | Pankuch et al. | 123/41.05 |
| 2,667,843 | 2/1954 | Dean | 165/41 |
| 3,229,896 | 1/1966 | Levy | 417/423.8 |
| 3,384,165 | 5/1968 | Mathews | 165/39 |
| 4,539,943 | 9/1985 | Tsuchikawa et al. | 123/41.05 |
| 5,002,019 | 3/1991 | Klaucke et al. | 123/41.12 |

FOREIGN PATENT DOCUMENTS

| | | | |
|---|---|---|---|
| 690955 | 5/1940 | Germany | 165/41 |
| 0120749 | 7/1984 | Japan | 123/41.05 |
| 2203268 | 10/1988 | United Kingdom | 123/41.12 |

*Primary Examiner*—John K. Ford
*Attorney, Agent, or Firm*—Jill M. Breedlove; Marvin Snyder

[57] ABSTRACT

A radiator assembly for a locomotive is provided. The locomotive has an engine for driving the locomotive and a cooling water system for circulating cooling water through the engine to operatively control the temperature of the engine, the assembly including a radiator in fluid communication with the cooling system and a fan which selectively draws air through the radiator and into the inlet of the fan. The radiator assembly also includes a shutter for selectively controlling the drawn air flow through the radiator and a control system operatively attached to the shutter for actuating the shutter to control the drawn air flow in dependence on a determined control temperature. The control assembly is also operatively attached to the fan to select and set the speed of the fan in dependence on the determined control temperature.

9 Claims, 13 Drawing Sheets

SHUTTERED RADIATOR SYSTEM WITH CONTROL

This application is a continuation of application Ser. No. 08/060,108, filed May 10, 1993, abandoned.

BACKGROUND OF THE INVENTION

The invention relates generally to a shuttered radiator assembly and the control system thereof and more particularly to a radiator assembly and control system for a locomotive, the assembly including a fan and independently actuated shutter and the control system controlling the fan and shutter position to operatively vary the air flow across the radiator.

There are many types of locomotives such as what is referred to as the platform design locomotive. Another type of locomotive is referred to as a monocoque. A monocoque locomotive has a unitary carbody with a generally flat longitudinally extending platform on the lower side thereof. The carbody also includes two vertical sidewalls, one of which extends along each of the sides of the carbody. The sidewalls typically consist of a frame of interconnected vertical and horizontal supports. Thin sheet metal plates are overlaid on and attached to the outer surface of the frame. A frontal streamlined nose piece and a rear wall are also fashioned from the thin sheet metal.

The carbody provides the necessary structural support for the mounting of many of the components of the locomotive. The sidewalls and bulkheads which extend transversely across the platform form individual compartments into which the various locomotive components are constructed or placed. One of the compartments formed is a radiator compartment into which the radiator and accompanying fans are placed.

One well-known method for increasing the efficiency of the locomotive is to control the temperature of the diesel engine driving the locomotive so that the temperature is within an optimal range. The temperature of the engine is primarily controlled by the cooling system using water as the heat transfer medium. Therefore, the cooling system which includes the radiator and accompanying fan should be controlled so that the engine is maintained within the optimal temperature range.

Traditional radiator systems typically include a horizontally extending radiator which is mounted at the top of the rear end of the locomotive. Located below the radiator is a large fan which forces air across the radiator coils.

It is also known to place the fan on top of the radiators to suck the cooling air through the radiators; however, placing the fan above the radiators may expose the fan motor to very high temperatures which may shorten the operating life of the motor of the fan assembly.

The speed of the fan in either the traditional system or the sucker system is controlled in dependence on the sensed water temperature of the water leaving the engine of the locomotive. The fan may have several different speeds, such as half speed and full speed. In addition, the fan can be stationary.

Traditional radiator control systems typically cycle the fan between a number of different speeds to vary the cooling of the water going through the radiator and, therefore, control the temperature of the engine. A drawback of this type of radiator assembly and method of control is that even if the fan is not operating, such as when the radiator is subjected to a very cold ambient and the train is moving, the air will continue to flow through the radiator coils, thus continuing to cool the cooling water for the engine. The engine may then go below its optimal temperature range.

One of the drawbacks of these traditional radiator systems is that with the fan below the radiator, the fan motor extends downward into the radiator compartment, which limits head room particularly in the monocoque locomotive.

Also in the monocoque locomotive, the carbody hinders lateral access to components within the interior but the carbody includes removable roof hatches to allow vertical access. In the traditional radiator system the interior is easily accessed and components located therein may be removed fairly easily and so the components are mounted individually so they can be individually removed. In the monocoque locomotive if other components are individually attached to the structure of the locomotive above the component needing to be removed the other components must be removed which is a drawback.

It is therefore an object of the present invention, to provide a radiator assembly and control for a locomotive which prevents the flowing of air across the radiator even when a fan forming part of the radiator assembly is turned off. A related object is to provide a radiator assembly and control which prevents the flowing when the ambient air temperature is less than a predetermined level.

Another object of the present invention is to provide a radiator assembly and control in which all of the components thereof may be easily vertically withdrawn from the locomotive.

A further object of the present invention is to provide a radiator assembly and control which does not overly limit head room within the carbody.

SUMMARY OF THE INVENTION

Accordingly, a radiator assembly for a locomotive is provided. The locomotive has an engine for driving the locomotive and a cooling water system for circulating cooling water through the engine to operatively control the temperature of the engine, the assembly including a radiator in fluid communication with the cooling system and a fan which selectively draws air through the radiator and into the inlet of the fan. The radiator assembly also includes a shutter for selectively controlling the drawn air flow through the radiator and a control system operatively attached to the shutter for actuating the shutter to control the drawn air flow in dependence on a determined control temperature. The control assembly is also operatively attached to the fan to select and set the speed of the fan in dependence on the determined control temperature.

More particularly the locomotive includes a carbody with the engine being disposed within the carbody. The radiator is rigidly attached to a frame which extends about the periphery of the radiator, the fan means is also rigidly attached to the frame. Also the shutter is attached to the frame and located between the radiator and fan, wherein the frame, radiator, shutters and fan form a modular assembly. The frame is removably attached to the carbody so that the modular assembly may be easily disconnected and removed.

The control means also selects a first control temperature level for comparison to the determined control temperature level in dependence on whether the determined control temperature is increasing or decreasing.

BRIEF DESCRIPTIONS OF THE DRAWINGS

FIGS. 5*a*, 5*b*, 5*c*, 5*d*, 5*e*, 5*f*, 5*h*, and 5*i* is a flow diagram generally depicting a method for controlling the radiator assembly in accordance with the invention.

DESCRIPTION OF THE PREFERRED EMBODIMENTS

Figure 1:
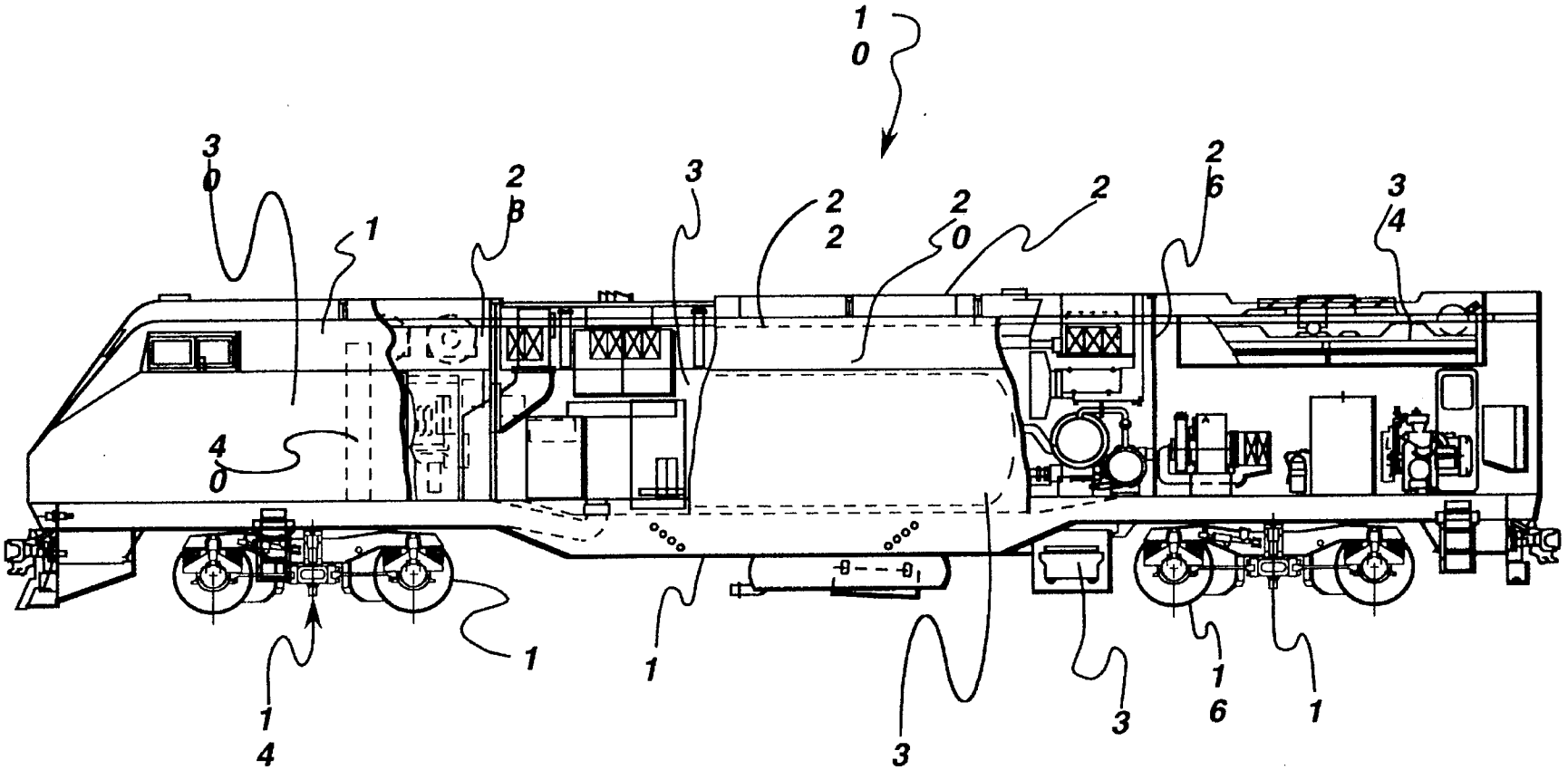
FIG. 1 is an elevational view, with parts broken away, of a locomotive which includes a shuttered radiator assembly and control system in accordance with the invention.

Referring to FIG. 1, a longitudinally extending locomotive is generally indicated at 10. The locomotive 10 is of a type generally referred to as a monocoque locomotive, and has a horizontal, generally flat platform 12. The platform 12 is mounted on a pair of trucks 14 having a set of rotatably mounted railroad wheels 16. The platform 12 forms a lower portion of a carbody 18.

The carbody 18 includes a pair of sidewalls 20 which extend along the sides of the platform 12. The sidewalls 20 include a horizontally extending cant rail 22 which extends along the top of the sidewall for at least a portion and preferably the entire length of the locomotive 10.

The carbody 18 also includes a number of roof hatches 24 which extends transverse across the platform 12 from sidewall 20 to sidewall. Also extending from sidewall 20 to sidewall, are bulkheads 26 which separate the carbody 18 into compartments. Included in the compartments are a forward crew compartment 30, an intermediate engine compartment 32 and a rearward radiator compartment 34.

Figure 2:
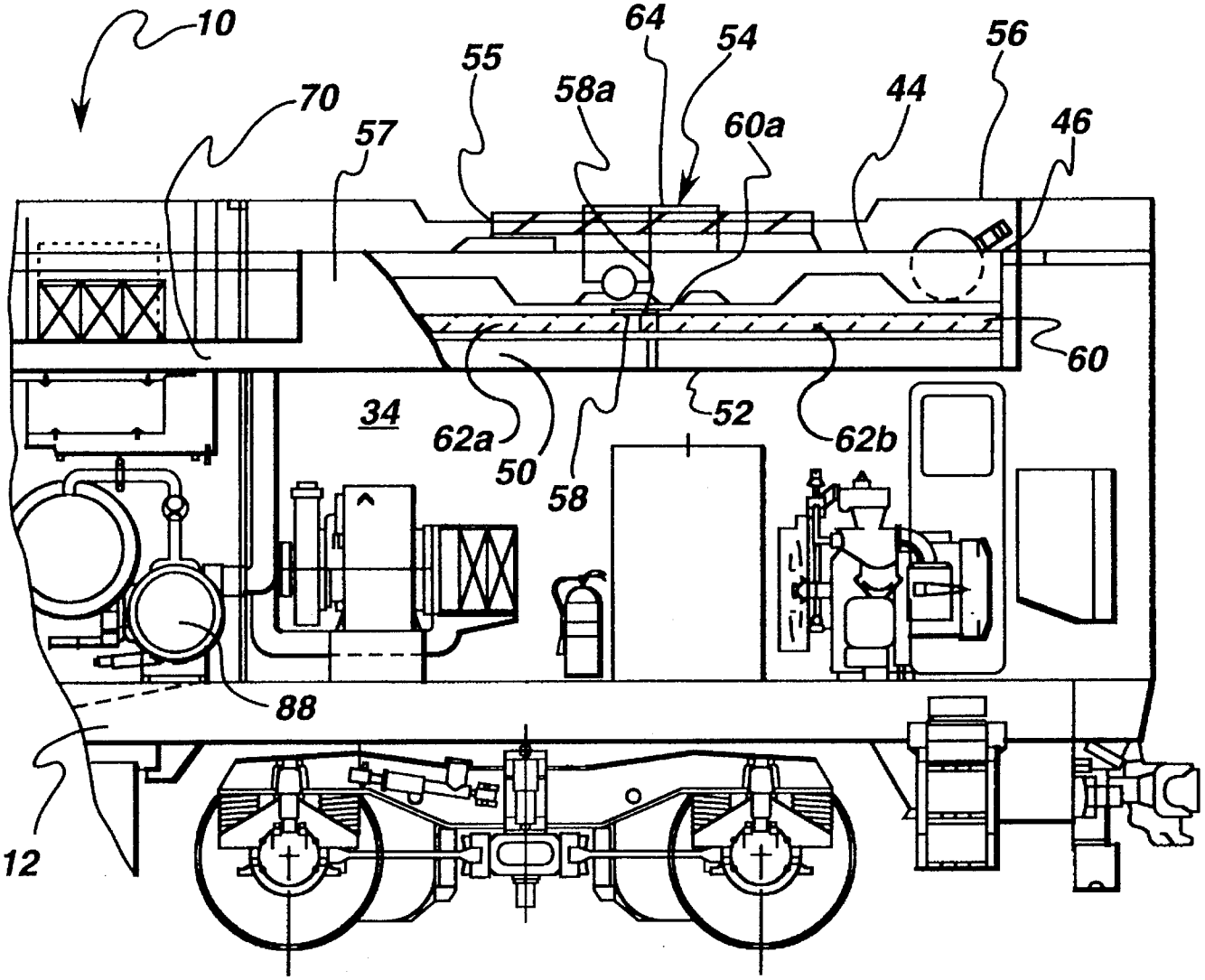
FIG. 2 is an enlarged view of the rear section of the locomotive of FIG. 1.

Referring to FIG. 2, within the radiator compartment 34 is a modular radiator assembly, indicated at 42. The radiator assembly 42 includes a longitudinally extending frame 44. The frame 44 extends from sidewall 20 to sidewall and is removably attached to the cant rail 22 for each sidewall with an attachment device 46, as set forth in Beiber et al., Ser. No. 08/059,788, reference herein.

Rigidly attached to the bottom of the frame 46 and extending horizontally within the frame is a forward radiator 50 and a similarly configured rear radiator 52 which is horizontally aligned with the forward radiator. Rigidly attached to the top of the frame 46 above the radiators 50, 52 and centrally located within the frame is a fan assembly 54 which is configured and rotated so that air is sucked up through the front and rear radiators 50, 52 and is exhausted upwards through an opening 55 formed in a radiator compartment roof hatch 56. The fan 54 so configured is generally referred to as a sucker-type fan. The roof hatch 56 is removably connected to the cant rail 22 of the sidewall 20 with the attachment devices 46.

To insure that the air flowing through the fan 54 passes through the forward and rear radiators 50, 52, the radiator assembly 42 includes an air shield 57 which extends about the horizontal periphery of the frame 44 and stretches vertically downward around the sides of the forward and rear radiators.

Rigidly attached to the frame 46 and disposed between the front radiator 50 and fan 54 and generally extending along and in close proximity to the top surface of the front radiator is a front shutter 58. Rigidly attached to the frame 46 and disposed between the rear radiator 52 and fan 54 and generally extending along and in close proximity to the top surface of the rear radiator is a rear shutter 60.

The front and rear shutters 58, 60 include transversely extending blades 62. The front shutter 58 is constructed to have blades 62*a* (FIG. 3) which are movable between an open position in which air flows freely through the shutter, preferably inclined about 80 to 85 degrees from the horizontal, and a closed position which may be a flat, overlapping position in which the front shutter effectively prevents the flow of air through the forward radiator 50. The rear shutter 60 also has blades 62*b* to independently control the flow of air through the rear radiator 52 and is constructed similar to the front shutter 58 so that the blades 62*b* may be placed in an open or closed position.

The front shutter 58 includes an air powered actuator 58*a* to operate the blades 62*a*. Similarly the rear shutter 60 includes an air powered actuator 60*a* to operate the blades 62*b*. The blades 62*a* of the front shutter 58 may be actuated independently from the blades 62*b* of the rear shutter 60.

The front and rear shutter 58, 60 also may be disposed beneath the forward and rearward radiators 50, 52, respectively. However, the disposition of the shutters above the radiators 50, 52, is preferred because the radiators also act as a shield to prevent operators from accidentally having their hands in the blades 62 of the shutters 58, 60, when the blades are actuated which may cause injury.

Figure 3:
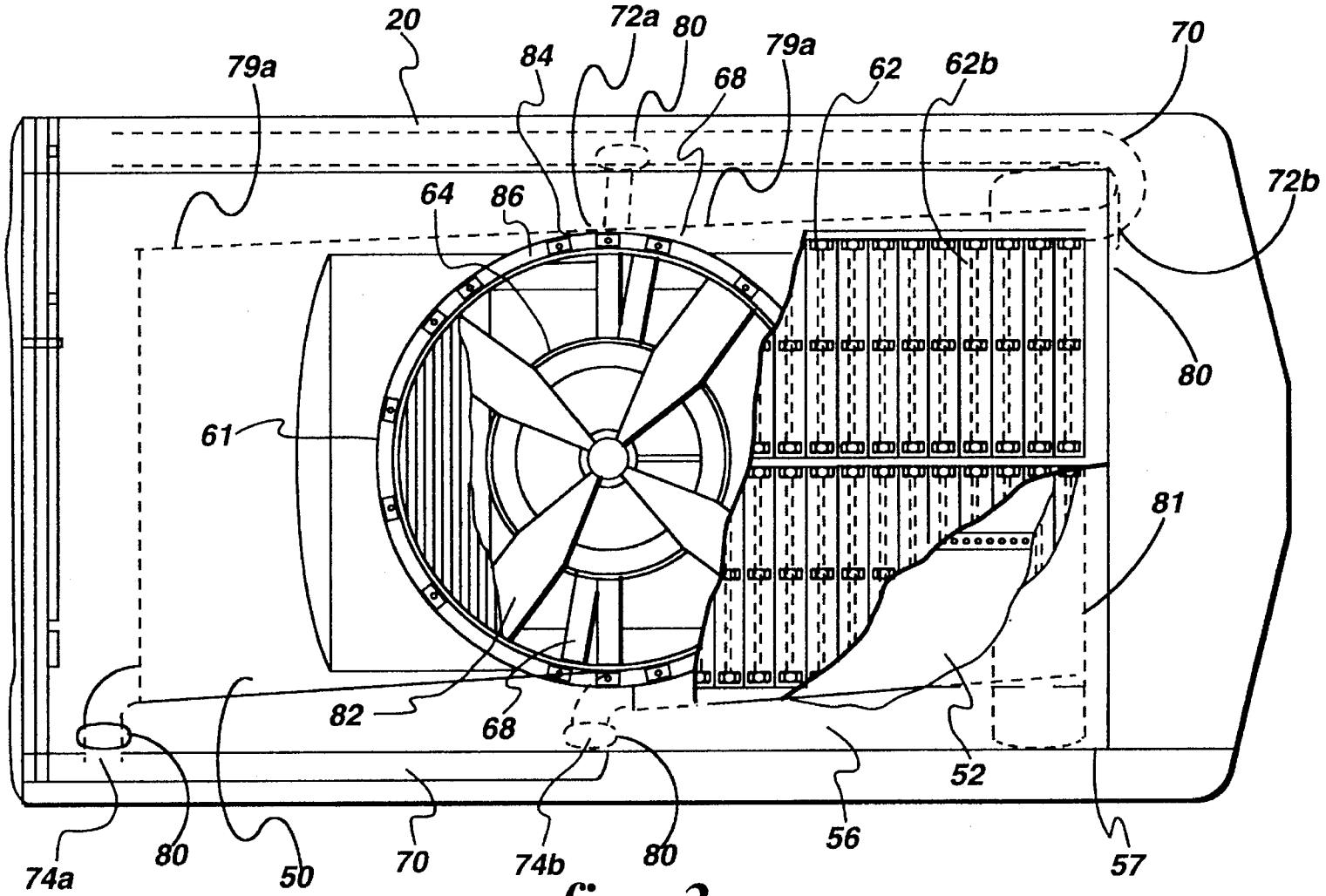
FIG. 3 is a top plan view of the rear end of the locomotive of FIG. 1.

Referring to FIG. 3, mounted on the frame 44 and horizontally extending between a motor 64 of the fan 54 and the front and rear shutters 58, 60 is a circular motor shield 66. The shield 66 has a circumference slightly larger than the circumference of the motor 64 and shields the motor 64 from the hot air exiting from the shutters 58, 60. To supply cool air to the motor 64, the frame 44 includes ducts 68 which extend generally horizontally and transversely from the base of the motor to outside of the air shield 57. Shielding the motor 64 from the hot air and supplying cooler air to the motor, helps prevent the motor from overheating.

The forward radiator 50, and rearward radiator 52 of the radiator assembly 42 are fluidly connected to water piping 70 which is in turn fluidly connected to the water pump 38 and engine 36 to form a portion of the water cooling system for the engine. As best seen in FIG. 3, water flows from the water piping 70 through inlets 72*a* and 72*b* of the forward and rearward radiators 50, and 52, respectively. Water flows back into the water piping 70 from houtlets 74*a* and 74*b* for the forward and rearward radiators 50, and 52, respectively.

The inlets 72*a* and 74*b* are located on the forward and rear radiators 50, 52 diagonally and horizontally across from the outlets 74*a* and 74*b*, respectively. The diagonal placement forces the water flowing through the radiators 50, 52 to crossflow across the radiators to improve the heat transfer over a configuration where the inlet and outlet are both on the same side portion of the radiator.

To provide the clearance for the connections between the water piping 70 and forward and rear radiators 50, 52, the horizontal perimeter of both the forward and rearward radiators 50, 52 is generally shaped in the form of a parallelogram with the parallel front and rear sides 76 extending transverse across the locomotive 10 and the parallel lateral sides 78 slightly offset to an imaginary perpendicular 79*a* to the front and rear sides.

The water piping 70 also includes connector devices 80 for providing removable connections between the water piping and forward and rear radiators 50, 52. Also fluidly connected to the water piping 70 is an expansion tank 81 disposed upwards of the rear shutter 60.

To remove the radiator assembly 42 from the carbody 18, the forward and rear radiators 50, 52 are disconnected at connectors 80 from the water piping 70. In addition electrical and signal conductors (not shown) for the fan and shutters are disconnected. The roof hatch 56 is disconnected from the carbody 18 and removed with an overhead lifting device (not shown). The entire radiator assembly 42 may then be removed, and therefore, the radiator assembly is a modular assembly.

Thus, if one of the components of the radiator assembly 42 such as the fan 54 needs maintenance, the radiator assembly may be removed very quickly to service the fan, and there is no need to attempt to service the component within the tight confines of the carbody.

Because the fan 54 includes a fan blade assembly 82 which may be rotating very quickly and fracture of a blade of the fan blade assembly may cause the blade to fly out of the radiator assembly 42 and pose a safety hazard, the roof hatch 56 includes a containment shield 84. The containment shield 84 circumscribes and is located just outside a fan shroud 86 which is attached to the roof hatch 56 and surrounds the opening 57. The containment shield is of sufficient thickness to contain any fractured blades. Because the fan 54 is forcing air upwards, the air exerts a downward force on the blades of the fan. Therefore, if a blade fractures, the fractured piece will likely move with a downward trajectory and the containment shield 84 forces the fractured blade downward into the radiator compartment 34.

In operation, cooling water flows from the engine 36 through the water piping 70 and into the forward and rear radiators 50, 52. In dependence on control signals from a radiator assembly control system 100, described below, the fan may be actuated and either the front shutter 58, rear shutter 60 or both may be opened or shut, to cause air to flow across the radiators 50, 52 and cool the water as the water flows through the radiators. The cooled water then exits the forward and rear radiators 50, 52 and flows into the water piping 70. The water then flows through the water piping 70, an oil cooler 88 and a water pump 38 (FIG. 1) and into the engine 36 where the process is repeated.

Figure 4:
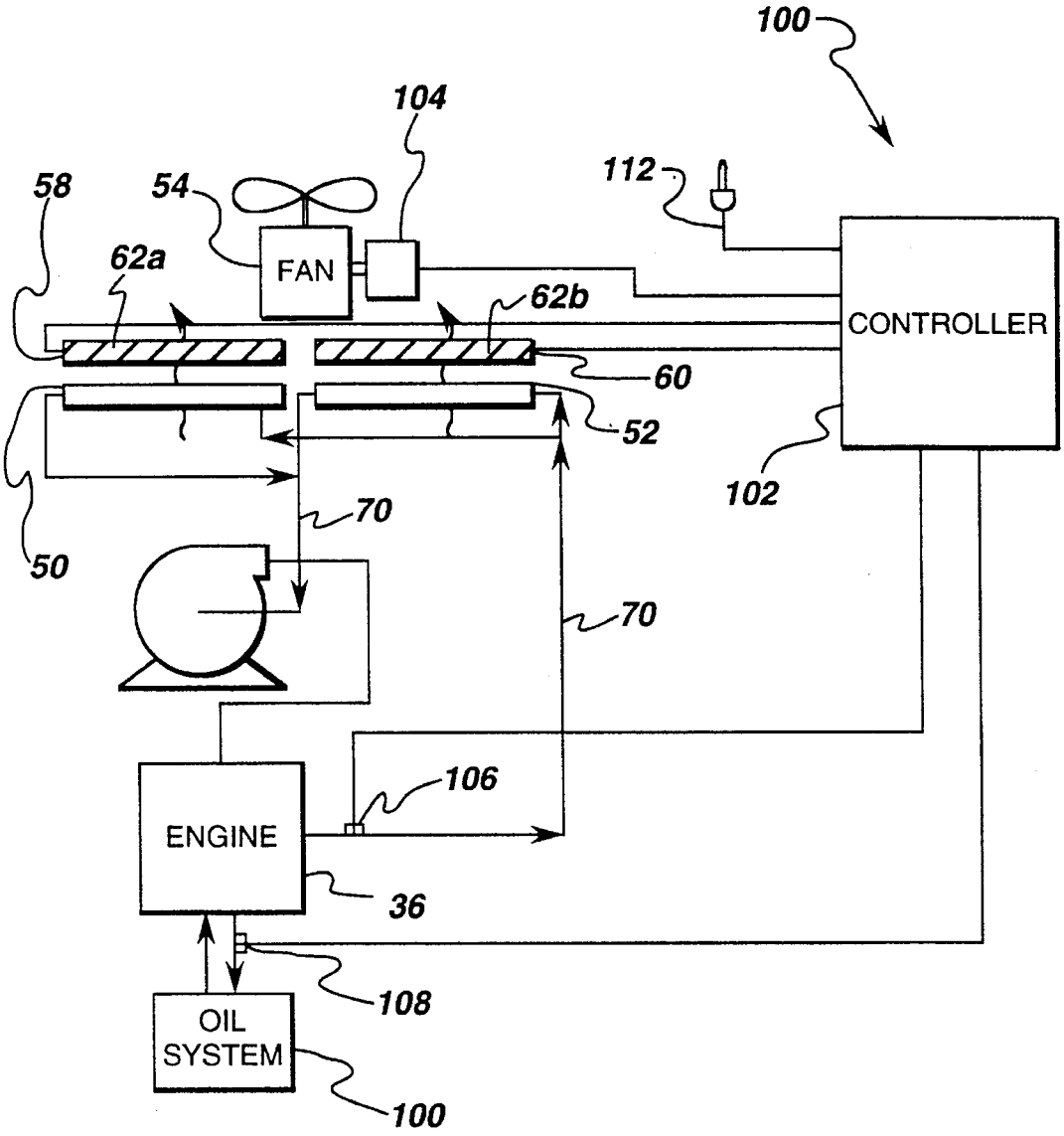
FIG. 4 is a schematic generally depicting a shuttered radiator assembly and control system in accordance with the invention.
Figure 5A:
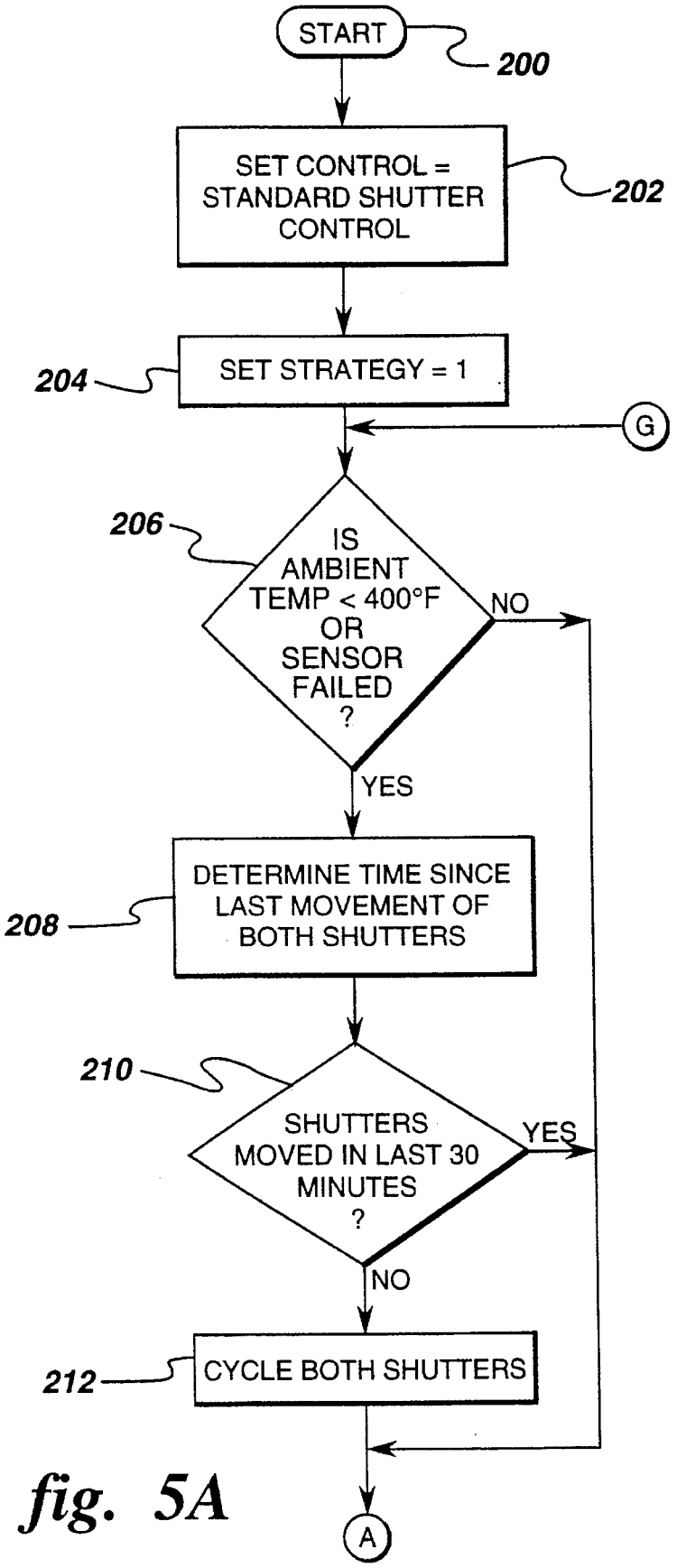
Figure 5B:
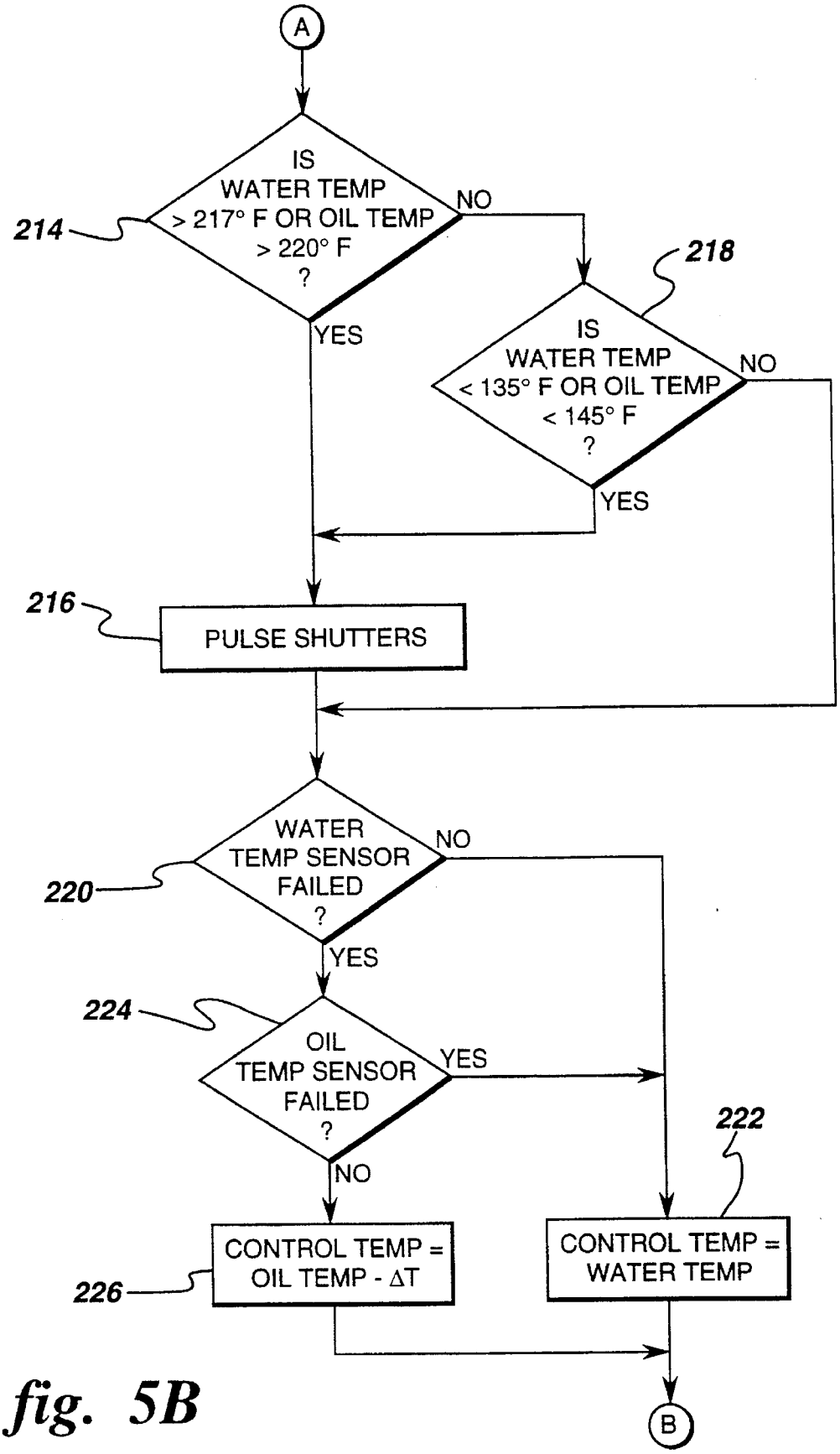
Figure 5C:
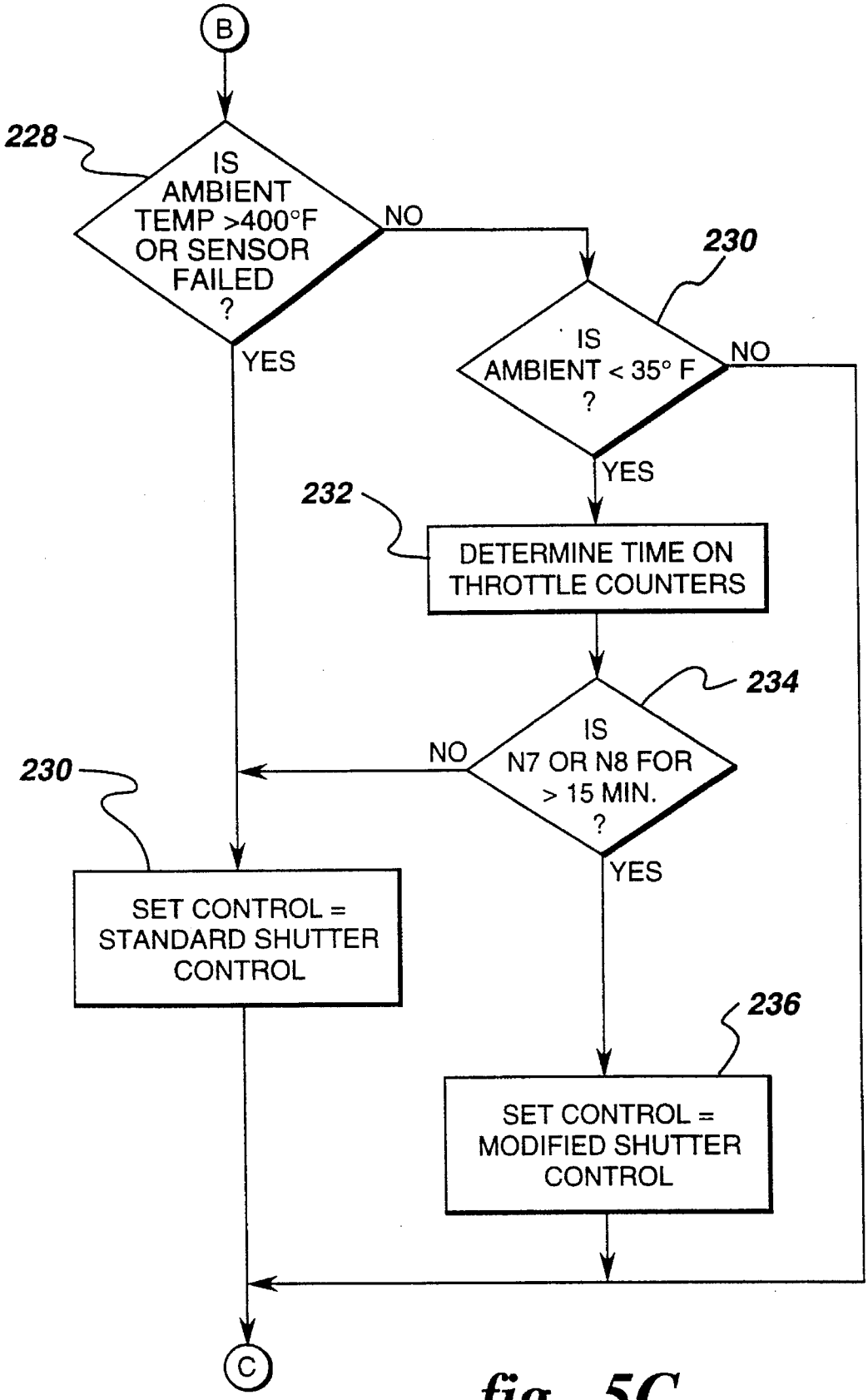
Figure 5D:
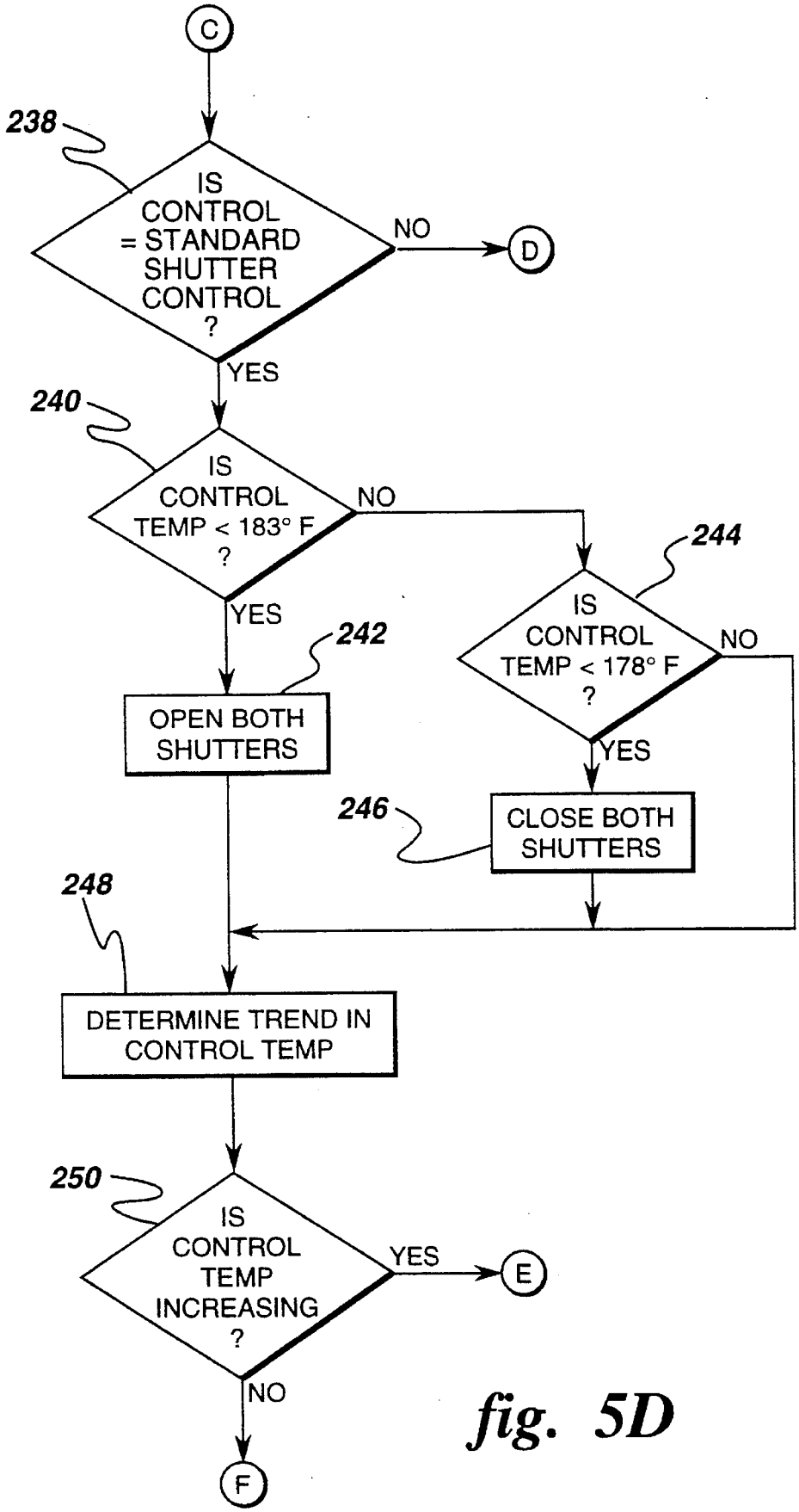
Figure 5E:
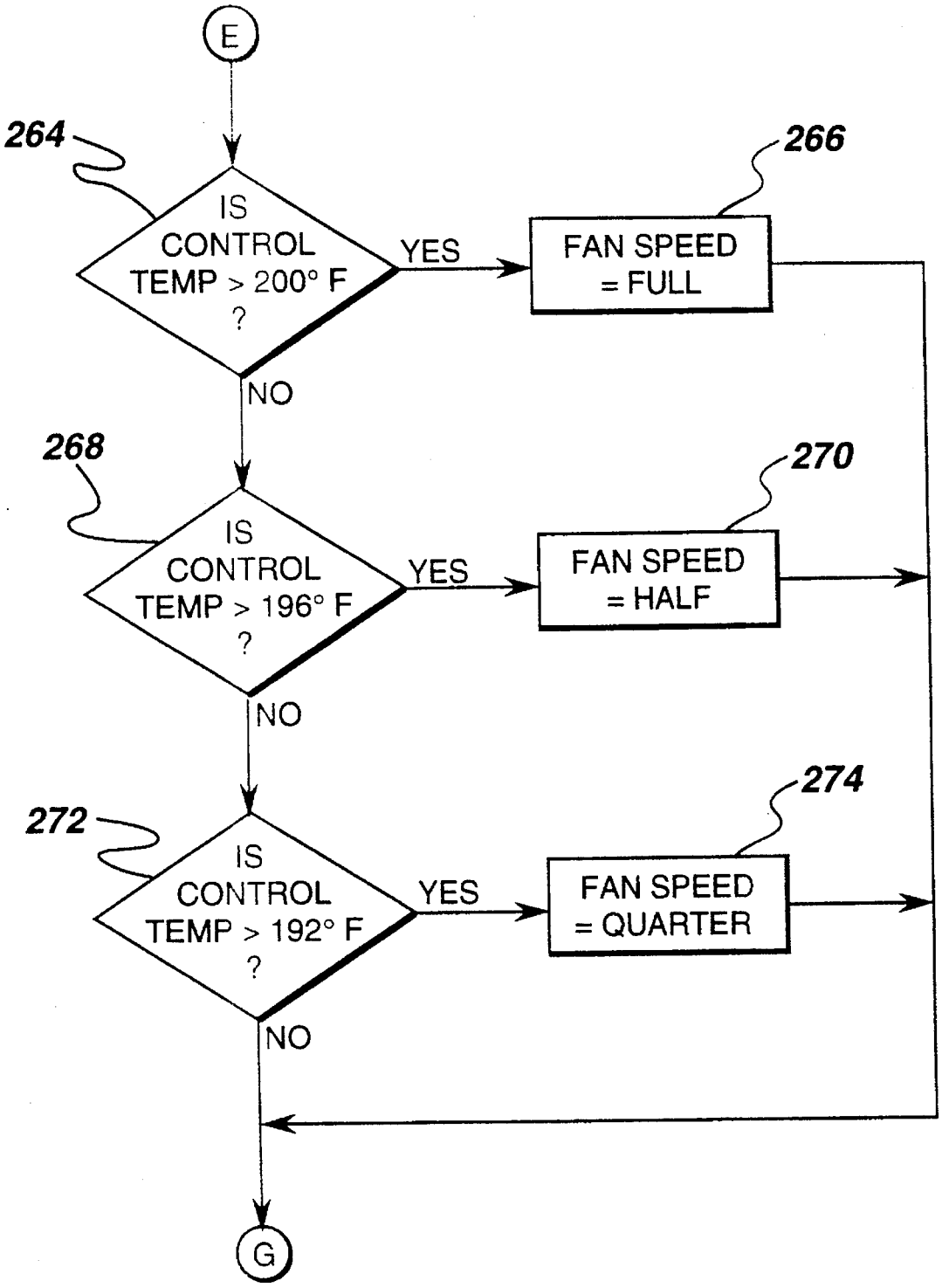
Figure 5F:
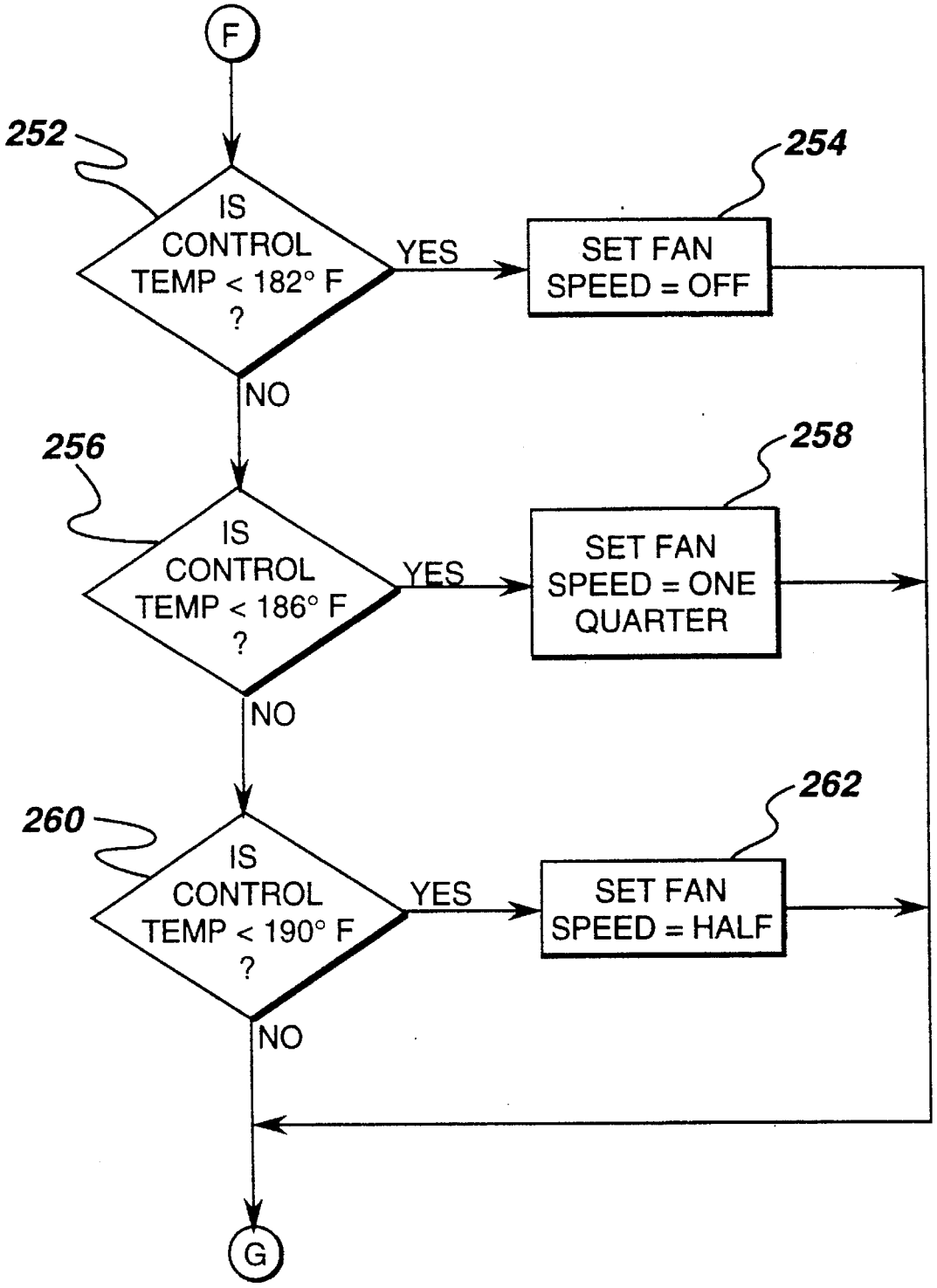
Figure 5G:
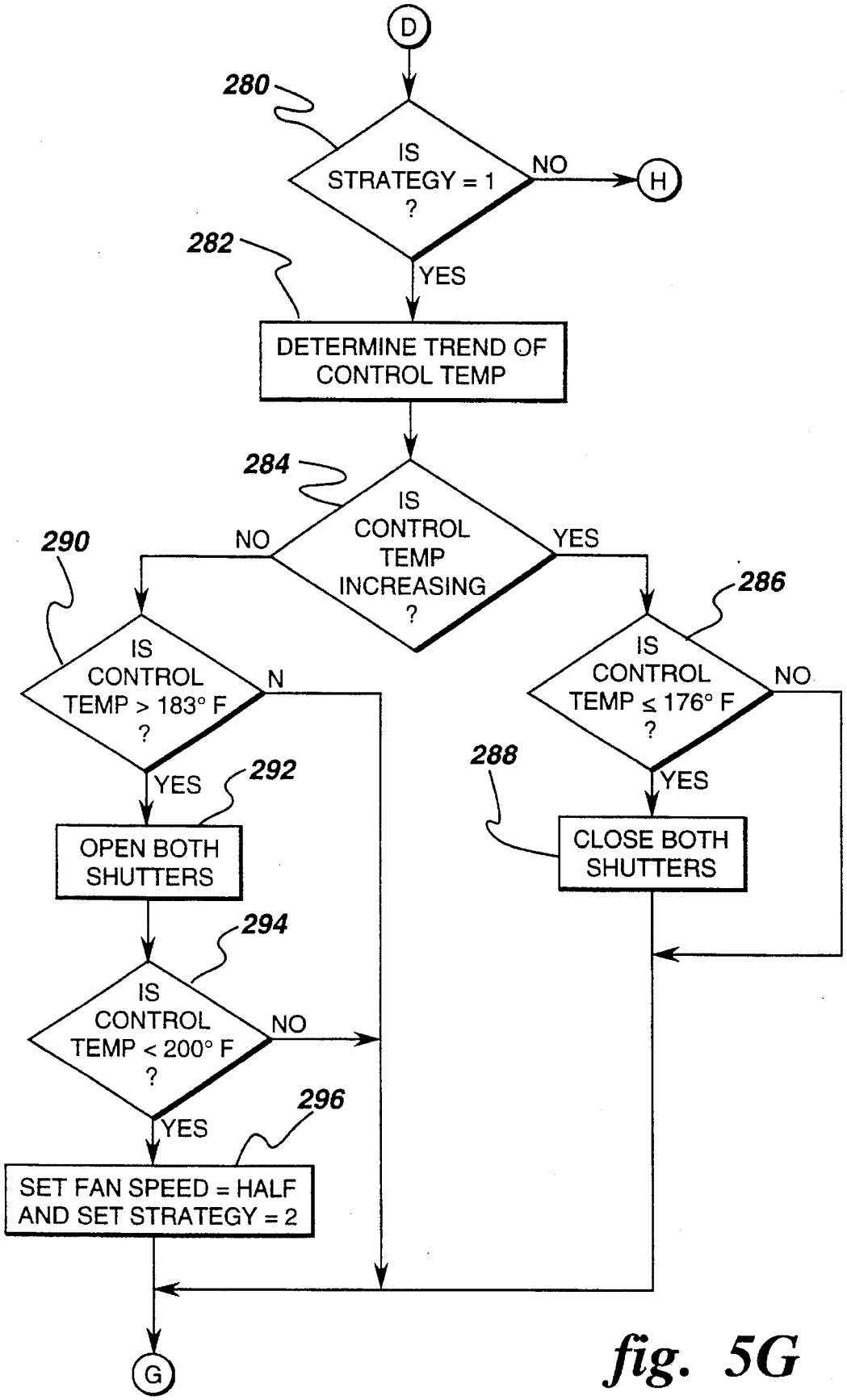
Figure 5H:
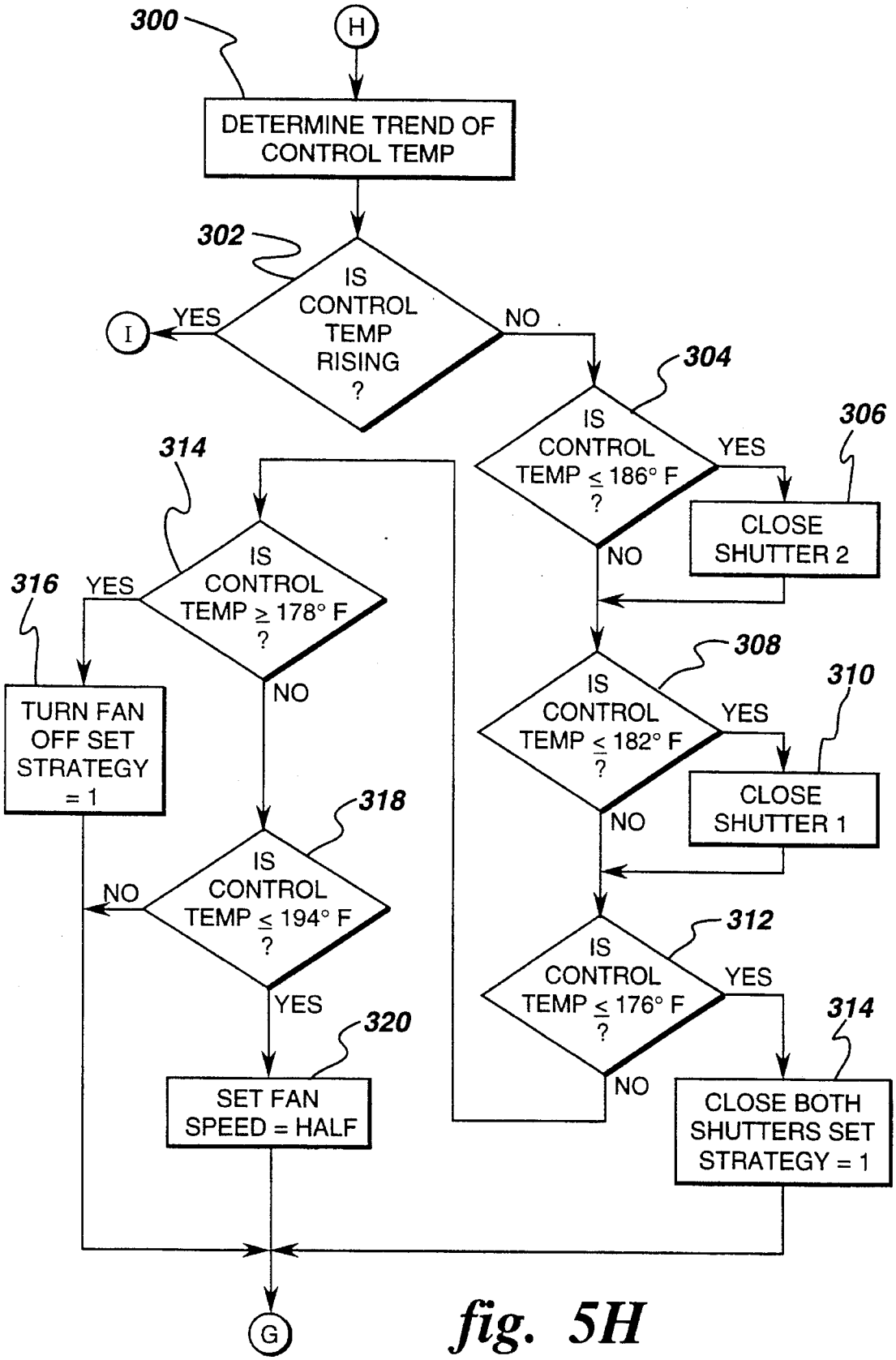
Figure 5I:
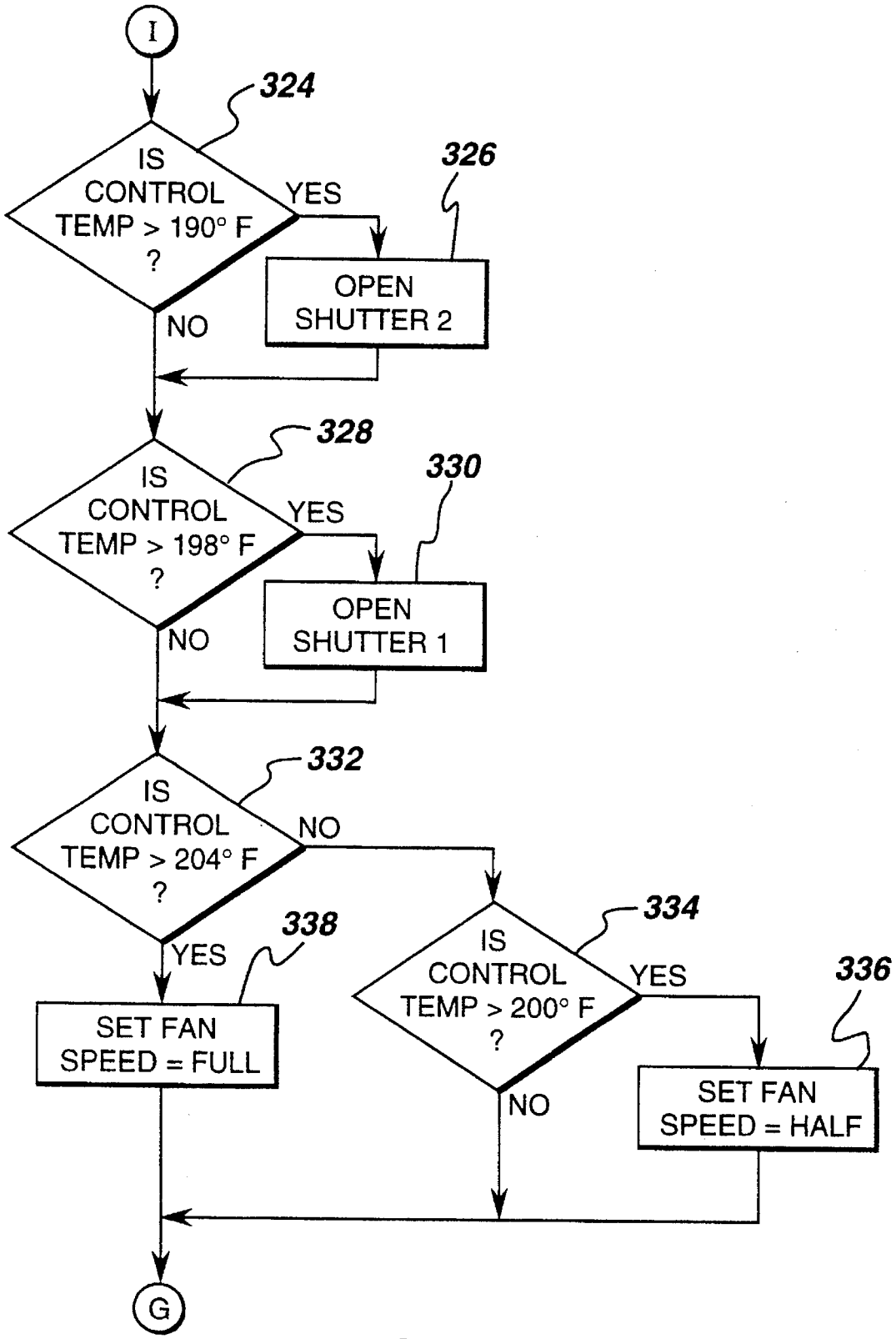

FIG. 4 schematically depicts a radiator assembly control system generally indicated as 100 wherein the flow of air across the forward and rear radiators 50, 52 is controlled. The control system 100 includes a controller 102, such as an engine control computer, which is coupled independently to the front and rear shutters 58, 60 and can controlledly operate the front and rear shutters to place the blades 62 of either the front or rear shutter in the open or closed position.

The controller 102 is also coupled to a motor control 104 which controls the motor 64 of the fan 54. The controller 102 may actuate the motor control 104 to cause the fan 54 to operate at a plurality of discrete speeds which preferably include one-quarter, one half and full speed. The controller 102 is coupled to a number of input devices which include a water temperature sensing device 106 which is located on the cooling water piping between the engine 36 and forward and rear radiators 50,52 and senses the temperature of the water flowing from the engine 38, an oil temperature sensing device 108 which is located on the inlet side of the oil cooler 88 and senses the temperature of the oil flowing from the engine 36 to an oil system 110, and an ambient temperature sensing device 112 which senses the temperature of the air outside the carbody 18 of the locomotive 10.

As described later, in dependence on the inputs from the water temperature sensor 106, the oil temperature sensor 108, and ambient air sensor 112, the controller 102 determines whether either the blades **62*a* of the front shutter 58 or the blades 62*b* of rear shutter 60 should be in the open or shut position and operates the front and rear shutter to place the blades in the position so determined. In addition, the controller 102 determines the desired rotational speed of the fan 54 and operates the motor control 104 to cause the fan to rotate at the desired speed. With the operation of the motor control 104 and front and rear shutters 58, 60, the controller 102 causes a desired flow rate of air to flow through the forward and rear radiators 50, 52 to obtain the proper cooling of the water flowing through the forward and rear radiators so that the engine 36** is maintained in the optimal temperature range.

FIGS. 5A, 5B, 5C 5D, 5E, 5F, 5H and 5I depict a method for independently positioning the blades **62*a* in the front shutter 58 and the blades 62*b* in the rear shutter 60 and setting the proper rotational speed of the fan 54 in accordance with the invention. The method also includes steps to determine whether the blades 62 of the front and rear shutter 58, 60 have been moved within a desired time period and then cause the blades to move and thereby prevent the blades from becoming stuck principally from the formation of ice. The method may further include steps to move the blades 62 of the radiators 50, 52** if the sensed oil temperature or water temperature is too high or too low which may indicate the blades as being stuck.

The method may start as indicated in block 200. Also referring to FIG. 4, upon initiation, the electronic controller 102 sets the control to standard shutter control as indicated in block 202. The controller also sets the strategy equal to one as indicated in block 204.

As indicated by block 206, the electronic controller 102 then determines whether the ambient temperature as sensed by ambient sensor device 112 is less than a first ambient temperature, such as 40° fahrenheit or if the sensor 112 has failed. If the ambient temperature is less than the first ambient temperature or the sensor has failed, the controller determines the time since the last movement of both shutters as indicated in block 208. The controller may use an internal clock and register which stores the time of the last movement of the shutters to calculate the time since the last movement of both shutters. The controller 102 then determines whether the shutters have moved in the last 30 minutes as indicated in block 210. If the shutters have not moved in the last 30 minutes, the controller then actuates the shutters to cycle both shutters as indicated in block 212. The term cycle refers to operating the forward and rear shutters 58, 60 to move the blades **62*a*, 62*b*, respectively, from the current position of the blades to the opposite position and back into the current position. For example, if one of the shutters has the blades 62 in the open position, the shutter will be cycled so that the blades go to the closed position and then back to the open position. It should be noted that the forward shutter 58 and rear shutter 60 may be in different positions and the controller cycles the forward shutter and rearward shutter independently. By cycling the blades 62 in low ambient temperatures, the control system 100** acts to prevent the formation of ice which may cause the blades to become inoperable.

If the shutters have moved in the last 30 minutes, the controller 102 does not cycle the shutters. Referring back to block 206, if the ambient temperature is greater than the first ambient temperature, and the ambient temperature sensor 112 is working properly, the controller does not cycle the shutters.

As indicated by block 214, the controller 102 then determines if the water temperature as sensed by the water temperature sensing device 106 is greater than a high water temperature such as 217° fahrenheit or if the oil temperature, as sensed by the oil temperature sensing device 108, is greater than a high oil temperature, such as 220° fahrenheit. If the water temperature is greater than the high water temperature or the oil temperature is greater than the high oil temperature, the controller cycles the shutters as indicated by block 216. If the water temperature is not greater than the high water temperature or the oil temperature is not greater than the first high oil temperature, the controller then determines whether the water temperature is less than a first low water temperature, such as 135° fahrenheit or the oil temperature is less than a first low oil temperature, such as 145° fahrenheit, as indicated in block 218. If the water temperature is less than the first low water temperature or the oil temperature is less than the first low oil temperature, the controller then cycles the shutters as indicated in block 216. If the water temperature is not less than the first low water temperature or the oil temperature is not less than the first low oil temperature, the controller 102 does not cycle the shutters. When the sensed oil temperature or water temperature is too hot or too cold the blades may be stuck; therefore, the cycling of the blades may cause the blades to become free.

Next the controller 102 determines the control temperature. As indicated in block 220, the controller 102 then determines whether the water temperature sensor 106 has failed. If the water temperature sensor has not failed, the control temperature is set to the water temperature as sensed by the water temperature sensor, as indicated by block 222. If the water temperature sensor has failed, the controller then determines if the oil temperature sensor 108, has failed, as indicated by block 224. If the oil temperature sensor has failed, the controller sets the control temperature to the water temperature as indicated by block 222. If instead the oil temperature sensor has not failed, the controller then sets the control temperature as equal to the sensed oil temperature minus a delta t such as 10°, as indicated by block 226.

Next the controller determines the proper shutter control. As indicated by block 228, the controller 102 then determines whether the ambient temperature as sensed by the ambient temperature sensing device 112 is greater than a second ambient temperature such as 45° fahrenheit or if the ambient sensor has failed. If the ambient temperature is greater than the second ambient temperature, or the ambient sensor has failed, the controller sets the control equal to standard shutter control as indicated by block 230. If the sensed ambient temperature is less than the second ambient temperature, and the ambient sensor has not failed, the controller 102 then determines whether the sensed ambient temperature is less than a third ambient temperature, such as 35°, as indicated in block 230. If the sensed ambient temperature is not less than the third ambient temperature, the controller makes no change in the standard shutter control.

If the sensed ambient temperature is less than the third ambient temperature, the controller 102 then determines the time period the locomotive has been operating on the different throttle notches and the time period for each throttle notch, as indicated by block 232. The controller 102 may use an internal clock and register which stores the time periods the locomotive has been operating on the different throttle notches.

As indicated by block 234, the controller then determines if the locomotive has been operating on the certain notches such as notch 7 or notch 8 for a time period greater than a second time period such as 15 minutes. If the locomotive has not been operating on the certain notches for greater than the second time period, the controller then sets the control equal to the standard shutter control as indicated in block 230. If the locomotive has been operating on the certain notches for greater than the second time period, the controller then sets the control equal to the modified shutter control as indicated by block 236.

The controller 102 next sets the blade positions and fan speed. As indicated by block 238, the controller 102 then determines whether the control has been set to the standard shutter control. If the control has been set to the standard shutter control, the controller 102 then determines whether the control temperature is less than the first control temperature, such as 183° fahrenheit, as indicated in block 240. If the control temperature is less than the first control temperature, the controller then actuates the forward shutter 58 and rearward shutter 60 to place the blades 62*a* and 62*b* respectively in the open position, as indicated in block 242. If the control temperature is not less than the first control temperature, the controller then determines if the control temperature is less than a second control temperature, such as 178° fahrenheit, as indicated in block 244. If the control temperature is not less than the second control temperature, the controller 102 makes no change in the position of the shutters. If the control temperature is less than the second control temperature, the controller 102 then actuates the forward and rearward shutters 58, 60 to place the blades 62*a*, 62*b*, respectively in the closed position as indicated in block 246.

As indicated in block 248, the controller then determines the trend of the control temperature. The controller may do this by maintaining a record stored in a memory device such as a RAM of previously determined control temperatures. Then the controller determines if the control temperature has been increasing as indicated by block 250. Depending on whether the trend of stored control temperatures indicates an increasing or not increasing control temperature, the controller 102 selects different predetermined control temperature levels to selectively operate the shutters 50, 52 and motor control 104.

If the control temperature has not been increasing, the controller then determines where the control temperature is less than a third control temperature, such as 182° fahrenheit, as indicated in block 252. If the control temperature is less than the third control temperature, the controller sets the fan speed using motor control 104 to off. If the control temperature is not less than the third control temperature, the controller then determines where the control temperature is less than a fourth control temperature, such as 186° fahrenheit, as indicated in block 256. If the control temperature is less than the fourth control temperature, the controller 102 then actuates the motor control 104 to set the fan speed equal to one quarter as indicated in block 258.

If the control temperature is not less than the fourth control temperature, the controller 102 then determines if the control temperature is less than a fifth control temperature, such as 190° fahrenheit, as indicated in block 260. If the controlled temperature is less than the fifth control temperature, the controller actuates the motor control 104 to set the fan speed to half speed as indicated in block 262. If the control temperature is not less than 190° fahrenheit, the controller makes no change to the fan speed. After the controller 102 has set the new fan speed or made no change, the controller may then return to block 206 to determine if the ambient temperature is less than the first ambient temperature or the ambient sensor has failed.

Referring back to block 250, if the controller 102 determines that the control temperature is increasing the controller determines if the control temperature is greater than a sixth control temperature, such as 200° fahrenheit, as indicated in block 264. If the control temperature is greater than the sixth control temperature, the controller 102 actuates the motor control 104 to set the fan speed equal to full, as indicated in block 266.

If the controller determines that the control temperature is not greater than the sixth control temperature, the controller then determines if the control temperature is greater than a seventh control temperature, such as 196° fahrenheit, as indicated in block 268. If the control temperature is greater than the seventh control temperature, the controller 102 actuates the motor control 104 to set the fan speed equal to half speed as indicated in block 270. If the controller determines that the control temperature is not greater than the seventh control temperature, the controller then determines if the control temperature is greater than an eighth control temperature, such as 192° fahrenheit, as indicated in block 272. If the controller determines that the control temperature is greater than the eighth control temperature, the controller 102 actuates motor control 104 to set the fan speed equal to quarter speed as indicated in block 274. If the controller determines that the control temperature is not greater than the eighth control temperature, the controller makes no change to the fan speed. After the controller 102 has set the fan speed or made no change, the controller then returns to block 206 to determine whether the ambient temperature is less than the first ambient temperature or the ambient sensor has failed.

Referring back to block 238, if the controller 102 determines the control is not equal to the standard shutter control, as indicated in block 280, the controller 102 then determines if the control strategy is equal to one. If the control strategy is equal to one, the controller then determines the trend of the control temperature as indicated in block 282. The controller then determines if the control temperature is increasing as indicated in block 284. If the control temperature is not increasing, the controller then determines whether the temperature is less than or equal to a ninth control temperature, such as 176° fahrenheit, as indicated in block 286. If the control temperature is less than or equal to the ninth control temperature, the controller actuates the forward and rear shutters 58, 60, to place the blades **62*a* and 62*b*, respectively, in the closed position as indicated in block 288. The controller then returns to block 206** to determine whether the ambient temperature is less than the first ambient temperature or the ambient sensor has failed.

If the control temperature is not less or equal to the ninth control temperature, the controller makes no change in the position of the shutters and returns to block 206 to determine whether the ambient temperature is less than the first ambient temperature or the ambient sensor has failed.

Referring back to block 284, if the controller 102 determines that the control temperature is increasing, the controller then determines if the control temperature is greater than a tenth control temperature, such as 183° fahrenheit, as indicated in block 290. If the control temperature is not greater than the tenth control temperature, the controller makes no change and returns to block 206 to determine if the ambient temperature is less than the first ambient temperature or the ambient sensor has failed. If the controller determines that the control temperature is greater than the tenth control temperature, the controller 102 actuates the forward and rear shutters 58, 60 to place the blades **62*a* and 62*b*, respectively, in the open position, as indicated in block 292**.

The controller 102 then determines if the control temperature is greater than an eleventh control temperature, such as 200° fahrenheit, as indicated in block 294. If the control temperature is not greater than the eleventh control temperature, the controller makes no change and returns to block 206 to determine if the ambient temperature is less than the first ambient temperature or the ambient sensor has failed. If the controller determines that the control temperature is greater than the eleventh control temperature, the controller 102 actuates motor control 104 to set the fan speed equal to half speed and the controller sets the strategy equal to two as indicated in block 296. The controller then returns to block 206 to determine if the ambient temperature is less than the first ambient temperature or the ambient sensor has failed.

Referring back to block 280, if the controller determines that the strategy is not equal to one, meaning the strategy is equal to two, the controller then determines the trend of the control temperature as indicated in block 300. The controller 102 then determines whether the control temperature is increasing as indicated in block 302. If the control temperature is not increasing, the controller then determines if the control temperature is less than or equal to a twelfth control temperature, such as 186° fahrenheit, as indicated in block 304. If the controller determines the control temperature is less than or equal to the twelfth control temperature, the controller then actuates the rearward shutter 60 to place the flap **62*b* in the closed position as indicated in block 306. If the controller 102** determines that the control temperature is not less than or equal to the twelfth control temperature, the controller makes no change.

As indicated in block 308, the controller 102 then determines whether the control temperature is less than or equal to a thirteenth control temperature, such as 182° fahrenheit. If the control temperature is less than or equal to the thirteenth control temperature, the controller actuates the forward shutter 58 and places the flap **62*a* in the closed position, as indicated in block 310**. If the controller determines that the control temperature is not less than or equal to the thirteenth control temperature, the controller makes no change.

As indicated in block 312, the controller 102 then determines whether the control temperature is less than or equal to a fourteenth control temperature, such as 176° fahrenheit. If the control temperature is less than or equal to the fourteenth control temperature, the controller actuates the forward and rear shutters 58, 60, to set the blades **62*a*, 62*b* respectively in the closed position and sets the strategy equal to one as indicated in block 314. After the controller has closed the blades 62*a*, 62*b* and set the strategy equal to one, the controller 102 returns to block 206** to determine if the ambient temperature is less than the first ambient temperature or the ambient sensor has failed.

Returning back to block 312, if the controller determines that the control temperature is not less than or equal to the fourteenth control temperature, the controller 102 then determines if the control temperature is less than or equal to a fifteenth control temperature, such as 178° fahrenheit, as indicated in block 314. If the controller determines that the control temperature is less than or equal to the fifteenth control temperature, the controller activates the motor control 104 to turn the fan off and sets the strategy equal to one as indicated in block 316. The controller then returns to block 206 to determine if the ambient temperature is less than the first ambient temperature or the ambient sensor has failed.

Returning back to block 314, if the controller determines that the control temperature is not less than or equal to the fifteenth control temperature, the controller then determines whether the control temperature is less than or equal to a sixteenth control temperature, such as 194° fahrenheit, as indicated in block 316. If the controller then determines that the control temperature is not less than or equal to the sixteenth control temperature, the controller makes no change and returns to block 206 to determine if the ambient temperature is less than the first ambient temperature or the ambient sensor has failed. If the controller determines that the control temperature is less than or equal to the sixteenth control temperature, the controller activates the motor control 104 to set the fan speed equal to half speed and returns to block 206 to determine if the ambient temperature is less than the first ambient temperature or the ambient sensor has failed.

Returning back to block 302, if the controller determines that the control temperature is increasing, the controller then determines if the control temperature is greater than a seventeenth control temperature, such as 190° fahrenheit, as indicated in block 324. If the controller determines that the control temperature is greater than the seventeenth control temperature, the controller 102 activates the rear shutter 60 to set the flap 62*b* in the open position as indicated in block 326. After the controller has set the flap 62*b* in the open position or the controller has determined that the control temperature is not greater than the seventeenth control temperature, the controller then determines whether the control temperature is greater than an eighteenth control temperature, such as 198° fahrenheit, as indicated in block 328. If the controller 102 determines that the control temperature is greater than the eighteenth control temperature, the controller activates the forward shutter 58 to set the flap 62*a* in the open position, as indicated in block 330.

After the controller has activated the forward shutter 58 or determined that the control temperature is not greater than the eighteenth control temperature, the controller then determines whether the control temperature is greater than a nineteenth control temperature, such as 204° fahrenheit, as indicated in block 332. If the controller determines that the control temperature is not greater than the nineteenth control temperature, the controller then determines whether the control temperature is greater than a twentieth control temperature, such as 200° fahrenheit, as indicated in block 334. If the controller 102 determines that the control temperature is greater than the twentieth control temperature, the controller activates the motor control 104 to set the fan speed equal to half speed as indicated in block 336. After the controller has set the fan speed equal to half speed or determined that the control temperature is not greater than the twentieth control temperature, the controller returns to block 206 to determine if the ambient temperature is less than the first ambient temperature or the ambient sensor has failed.

Referring back to block 332, if the controller determines that the control temperature is greater than a nineteenth control temperature, the controller activates the motor control 104 to set the fan speed equal to full speed, as indicated in block 338. The controller then returns to block 206 to determine if the ambient temperature is less than the first ambient temperature or the ambient sensor has failed.

A specific embodiment of the novel shuttered radiator assembly and control according to the present invention has been described for the purposes of illustrating the manner in which the invention may be made and used. It should be understood that implementation of other variations and modifications of the invention in its various aspects will be apparent to those skilled in the art, and that the invention is not limited by the specific embodiment described. It is therefore contemplated to cover by the present invention any and all modifications, variations, or equivalents that fall within the true spirit and scope of the basic underlying principles disclosed and claimed herein.

We claim:

1. A radiator assembly for an engine having a cooling water system for circulating cooling water through the engine to operatively control the temperature of the engine, the assembly including:

a radiator in fluid communication with the cooling system;

a fan means, including a motor for driving said fan means, for selectively drawing air through the radiator and into the inlet of the fan means;

a shutter means for selectively controlling the drawn air flow through the radiator;

a motor shield for shielding the motor from relatively hot air exiting from the shutter means;

air ducts situated about the motor for supplying relatively cool air to cool the motor; and control means comprising an engine control computer responsive to a water temperature sensor, an ambient air temperature sensor and an oil temperature sensor, the control means being operatively attached to the shutter means for actuating the shutter means to control the drawn air flow in dependence on a determined control temperature, the control means including means operatively attached to the fan means for selecting and setting the speed of the fan means in dependence on the determined control temperature.

2. The assembly of claim 1 wherein the shutter means is disposed between the radiator means and fan means.

3. The assembly of claim 1 wherein the control means includes means for selecting a first control temperature level for comparison to the determined control temperature level in dependence on whether the determined control temperature is increasing or decreasing.

4. The assembly of claim 1 wherein the radiator is horizontally extending, and said motor shield is disposed between the fan means and the radiator means.

5. The assembly of claim 4 wherein the radiator assembly includes an air shield vertically extending about the sides of the radiator, and said air ducts extend generally horizontally from the base of the motor through the air shield for providing air to the motor.

6. The assembly of claim 1 wherein the radiator is generally flat and has two pairs of opposing sides, and the radiator includes at least one inlet and at least one outlet, the inlet being disposed diagonally across from the outlet.

7. The assembly of claim 6 wherein the pairs of sides of the radiator form a four sided parallelogram, one of the pair of opposing sides being offset to the other pair of opposing sides.

8. The assembly of claim 1 wherein the control means includes means for cycling the shutter means in dependence on the temperature of the ambient air.

9. The assembly of claim 1 wherein the control means includes means for cycling the shutter means in dependence on the determined control temperature.

* * * * *